US007784303B2

(12) United States Patent
Sakitani et al.

(10) Patent No.: US 7,784,303 B2
(45) Date of Patent: Aug. 31, 2010

(54) EXPANDER

(75) Inventors: Katsumi Sakitani, Osaka (JP); Michio Moriwaki, Osaka (JP); Masakazu Okamoto, Osaka (JP); Eiji Kumakura, Osaka (JP); Yume Inokuchi, Osaka (JP); Tetsuya Okamoto, Osaka (JP); Yoshinari Sasaki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 630 days.

(21) Appl. No.: 11/659,343

(22) PCT Filed: Aug. 5, 2005

(86) PCT No.: PCT/JP2005/014402

§ 371 (c)(1),
(2), (4) Date: Feb. 5, 2007

(87) PCT Pub. No.: WO2006/013961

PCT Pub. Date: Feb. 9, 2006

(65) Prior Publication Data

US 2008/0310983 A1 Dec. 18, 2008

(30) Foreign Application Priority Data

Aug. 6, 2004 (JP) ..... 2004-230929

(51) Int. Cl.
*F25B 41/06* (2006.01)

(52) U.S. Cl. ..... 62/527; 62/511

(58) Field of Classification Search ..... 62/511, 62/527, 528

See application file for complete search history.

(56) References Cited

U.S. PATENT DOCUMENTS

| | | | | |
|---|---|---|---|---|
| 5,836,283 | A | 11/1998 | Kajino et al. | |
| 6,032,636 | A | 3/2000 | Kajino et al. | |
| 2005/0223734 | A1 * | 10/2005 | Smith et al. | 62/402 |

FOREIGN PATENT DOCUMENTS

| | | | |
|---|---|---|---|
| JP | 52-104644 | A | 9/1977 |
| JP | 58-133401 | A | 8/1983 |
| JP | 1-200001 | A | 8/1989 |
| JP | 7-224673 | A | 8/1995 |
| JP | 8-338356 | A | 12/1996 |
| JP | 10-205344 | A | 8/1998 |
| JP | 2001-116371 | A | 4/2001 |
| JP | 2002-364562 | A | 12/2002 |

* cited by examiner

*Primary Examiner*—Melvin Jones
(74) *Attorney, Agent, or Firm*—Birch, Stewart, Kolasch & Birch, LLP

(57) ABSTRACT

A positive displacement expander includes a volume change mechanism (90) for changing the volume of a first fluid chamber (72) of an expansion mechanism (60). The expansion mechanism (60) includes a first rotary mechanism (70) and a second rotary mechanism (80) each having a cylinder (71, 81) containing a rotor (75, 85). The first fluid chamber (72) of the first rotary mechanism (70) and a second fluid chamber (82) of the second rotary mechanism (80) are in fluid communication with each other to form an actuation chamber (66). Meanwhile, the first fluid chamber (72) of the first rotary mechanism (70) is smaller than the second fluid chamber (82) of the second rotary mechanism (80). The volume change mechanism (90) includes an auxiliary chamber (93) fluidly communicating with the first fluid chamber (72) and an auxiliary piston (92) for changing the volume of the auxiliary chamber (93). The auxiliary chamber (93) is in fluid communication with the first fluid chamber (72) of the first rotary mechanism (70).

7 Claims, 13 Drawing Sheets

(A)

(B)

(A)

(B)

(A)

(B)

EXPANDER

TECHNICAL FIELD

The present invention relates to expanders, and more particularly relates to the volumetric structures of expander chambers.

BACKGROUND ART

Expanders adapted to produce power by high-pressure fluid expansion have conventionally included positive displacement expanders, such as rotary expanders (see, for example, Patent Document 1). This type of expander can be used for the execution of an expansion process in a vapor compression refrigeration cycle (see, for example, Patent Document 2).

Such an expander has a cylinder and a piston which orbits inside the cylinder. An actuation chamber, defined between the cylinder and the piston, is divided into two zones, namely a suction/expansion side and a discharge side. With the orbital motion of the piston, the actuation chamber undergoes sequential switching that one zone serving as the suction/expansion side is switched to serve as the discharge side while the other zone serving as the discharge side is switched to serve as the suction/expansion side. In this way, the action of suction/expansion of refrigerant and the action of discharge of refrigerant are simultaneously concurrently achieved.

In the above-described expander, both the angular range of a suction process in which high-pressure refrigerant is supplied into the cylinder during a single revolution of the piston and the angular range of an expansion process in which the refrigerant is expanded are predetermined. In other words, for such a type of expander, the expansion ratio, i.e., the density ratio of suction refrigerant and discharge refrigerant, is generally constant. High-pressure refrigerant is introduced into the cylinder in the angular range of the suction process while on the other hand the refrigerant is expanded at a fixed expansion ratio in the angular range of the remaining expansion process for the recovery of rotational power.

Patent Document 1: Japanese Unexamined Patent Application Publication No. 8-338356

Patent Document 2: Japanese Unexamined Patent Application Publication No. 2001-116371

DISCLOSURE OF INVENTION

Problems that the Invention is to Solve

Positive displacement expanders have an inherent expansion ratio. On the other hand, in a vapor compression refrigeration cycle in which such an expander is used, the high-level pressure and the low-level pressure of the refrigeration cycle vary due to variations in the temperature of a target for cooling or due to variations in the temperature of a target for heat liberation (heating). The ratio of the high-level pressure and the low-level pressure (i.e., the pressure ratio) varies as well. In connection with this, the suction refrigerant and the discharge refrigerant of the expander each vary in density. Accordingly, in this case, the refrigeration cycle is operated at a different expansion ratio from the expansion ratio of the expander. This results in the drop in operation efficiency.

For example, under the operating conditions that cause decreasing of the pressure ratio of the vapor compression refrigeration cycle, the ratio of the density of refrigerant at the inlet of a compressor and the density of refrigerant at the inlet of an expander decreases. However, there is a case where both the compressor and the expander are positive displacement fluid machines and brought into fluid communication with each other by a single shaft. In this case, the ratio of the volume flow rate of refrigerant passing through the compressor and the volume flow rate of refrigerant passing through the expander is always constant and remains unchanged. For this reason, when the pressure ratio of the vapor compression refrigeration cycle decreases, the mass flow rate of refrigerant passing through the expander becomes excessively small relative to the mass flow rate of refrigerant passing through the compressor. Thus, so-called excessive expansion occurs.

With a view to coping with this, in the apparatus of the Patent Document 2, a bypass passageway is formed in parallel with the expander. The bypass passageway is equipped with a flow rate control valve. Under the operating conditions that cause decreasing of the pressure ratio of the vapor compression refrigeration cycle, refrigerant delivered to the expander is partially allowed to flow towards the bypass passageway so that refrigerant flows through the expander as well as through the bypass passageway. In this arrangement, however, the refrigerant that flows through the bypass passageway, i.e. the refrigerant that bypasses the expander, does no expansion work, thereby decreasing the amount of power recoverable by the expander and causing the operation efficiency to fall.

Conversely, under the operating conditions that cause increasing of the pressure ratio of the vapor compression refrigeration cycle, the ratio of the density of refrigerant at the inlet of a compressor and the density of refrigerant at the inlet of an expander increases. In this case, unless the ratio of the volume flow rate of refrigerant passing through the compressor and the volume flow rate of refrigerant passing through the expander were always constant, the expansion ratio of refrigerant in the expander would decrease, resulting in insufficient expansion.

The present invention is made in view of the above-mentioned problems, and its object is to avoid excessive expansion and insufficient expansion of refrigerant.

Means of Solving the Problems

As shown in FIG. 4, a first aspect of the invention is directed to a positive displacement expander used for a refrigerant circuit (20) of a supercritical refrigeration cycle. The expander includes a volume changer (90) for changing the volume of an expander chamber (72).

A second aspect of the invention is directed to the first aspect and characterized in that the volume changer (90) includes an auxiliary chamber (93) fluidly communicating with the expander chamber (72) and a piston (92) for changing the volume of the auxiliary chamber (93).

A third aspect of the invention is directed to the first aspect and characterized in that the volume changer (90) includes an auxiliary chamber (93) fluidly communicating with the expander chamber (72) and an opening/closing mechanism (96) placed between the auxiliary chamber (93) and the expander chamber (72).

A fourth aspect of the invention is directed to the first aspect and characterized in that the volume changer (90) includes an auxiliary chamber (93) fluidly communicating with the expander chamber (72) and an opening/closing mechanism (96) placed between the auxiliary chamber (93) and the expander chamber (72).

A fifth aspect of the invention is directed to the first aspect and characterized in that an expansion mechanism (60) including the expander chamber (72) includes a first rotary mechanism (70) and a second rotary mechanism (80) each having a cylinder (71, 81) containing a rotor (75, 85), the expander chamber (72) of the first rotary mechanism (70) and an expander chamber (82) of the second rotary mechanism (80) are in fluid communication with each other to form an actuation chamber (66), the expander chamber (72) of the first rotary mechanism (70) being smaller than the expander chamber (82) of the second rotary mechanism (80), and the volume changer (90) is in fluid communication with the expander chamber (72) of the first rotary mechanism (70).

A sixth aspect of the invention is directed to the first aspect and characterized in that an expansion mechanism (60) including the expander chamber (130) comprises a pair of scroll members (110, 120) each having an end plate and a spiral wrap (111, 121) formed on the end plate, the respective wraps (111, 121) of the scroll members (110, 120) engaging with each other, and is composed of a scroll mechanism (100) including at least one pair of expander chambers (130), and the volume changer (90) is in fluid communication with the expander chamber (130).

A seventh aspect of the invention is directed to the first aspect and characterized in that an expansion mechanism (60) forming the expander chamber (72) is connected to a compression mechanism (50) placed somewhere along the refrigerant circuit (20).

A eighth aspect of the invention is directed to the first aspect and characterized in that refrigerant used for the refrigerant circuit (20) is $CO_2$.

-Behaviors-

In the first aspect of the invention, under the operating conditions that cause decreasing of the pressure ratio of the vapor compression refrigeration cycle, the ratio of the density of refrigerant at the inlet of the compression mechanism (50) and the density of refrigerant at the inlet of an expansion mechanism (60) decreases. In this case, when the volume of the expander chamber (73) is constant, the mass flow rate of refrigerant passing through the expansion mechanism (60) becomes excessively small relative to the mass flow rate of refrigerant passing through the compression mechanism (50). Thus, excessive expansion occurs. To cope with this, the volume of the auxiliary chamber (93) of the volume changer (90) is increased, resulting in excessive expansion avoided.

For example, in the second aspect of the invention, the piston (92) of the volume changer (90) is moved to increase the volume of the auxiliary chamber (93). In the third aspect of the invention, the volume of the auxiliary chamber (93) is utilized by opening the opening/closing mechanism (96) of the volume changer (90). In the fourth aspect of the invention, the volume of the auxiliary chamber (93) is increased by adjusting the flow rate adjusting mechanism (96) of the volume changer (90).

On the other hand, for example, under the operating conditions that cause increasing of the pressure ratio of the vapor compression refrigeration cycle, the ratio of the density of refrigerant at the inlet of the compression mechanism (50) and the density of refrigerant at the inlet of an expansion mechanism (60) increases. In this case, when the volume of the expander chamber (73) is constant, the expansion ratio of the expansion mechanism (60) becomes small. Thus, insufficient expansion occurs. To cope with this, the volume of the auxiliary chamber (93) of the volume changer (90) is decreased, resulting in insufficient expansion avoided.

For example, in the second aspect of the invention, the piston (92) of the volume changer (90) is moved to decrease the volume of the auxiliary chamber (93). In the third aspect of the invention, the opening/closing mechanism (96) of the volume changer (90) is closed so that the volume of the auxiliary chamber (93) is not utilized. In the fourth aspect of the invention, the flow rate adjusting mechanism (96) of the volume changer (90) is adjusted to decrease the volume of the auxiliary chamber (93).

In the fifth aspect of the invention, the expander chamber (73) is composed of the two rotary mechanisms (70, 80). Thus, the volume of the expander chamber (73) is increased or decreased by the volume changer (90).

In the sixth aspect of the invention, the expander chamber (130) is composed of the scroll mechanism (100). Thus, the volume of the expander chamber (130) is increased or decreased by the volume changer (90).

In the seventh aspect of the invention, the compression mechanism (50) is driven by utilizing the pressure energy of refrigerant passing through the expansion mechanism (60).

In the eighth aspect of the invention, a refrigeration cycle is performed by circulating $CO_2$ refrigerant through the refrigerant circuit.

Effects of the Invention

As described above, according to the present invention, a volume change mechanism (90) is provided to increase or decrease the volume of an expander chamber (72). Therefore, an increase or a decrease in the volume of an auxiliary chamber (93) can avoid excessive expansion of refrigerant and certainly avoid insufficient expansion of refrigerant. As a result, the operation efficiency of an expander can be enhanced.

According to the second aspect of the invention, in the volume change mechanism (90), the volume of the auxiliary chamber (93) is adjusted by a piston (92). This can exactly increase or decrease the volume of the expander chamber (72). In addition, with a simple structure, the volume of the expander chamber (72) can be increased or decreased.

According to the third aspect of the invention, in the volume change mechanism (90), the auxiliary chamber (93) is opened/closed by an opening/closing mechanism (96). This can simply increase or decrease the volume of the expander chamber (72).

According to the fourth aspect of the invention, in the volume change mechanism (90), the volume of the auxiliary chamber (93) is adjusted by a flow rate adjusting mechanism (96). Thus, the adjustment of the flow rate of refrigerant can increase or decrease the volume of the expander mechanism (72).

According to the fifth aspect of the invention, the expansion mechanism (60) includes two rotary mechanisms (70, 80). This allows a high-pressure fluid chamber (73) and an expansion chamber (66) to be defined with reliability, thereby expanding refrigerant with reliability.

According to the sixth aspect of the invention, the expansion mechanism (60) includes a scroll mechanism (100). This scroll mechanism (100) allows refrigerant to expand.

According to the seventh aspect of the invention, since the expansion mechanism (60) is connected to the compression mechanism (50), the pressure energy of refrigerant can be recovered as power with reliability, resulting in an enhancement in operation efficiency.

According to the eighth aspect of the invention, since $CO_2$ is used as refrigerant, an environment-compatible refrigerant circuit (20) can be configured.

DESCRIPTION OF NUMERALS

Figure 1:
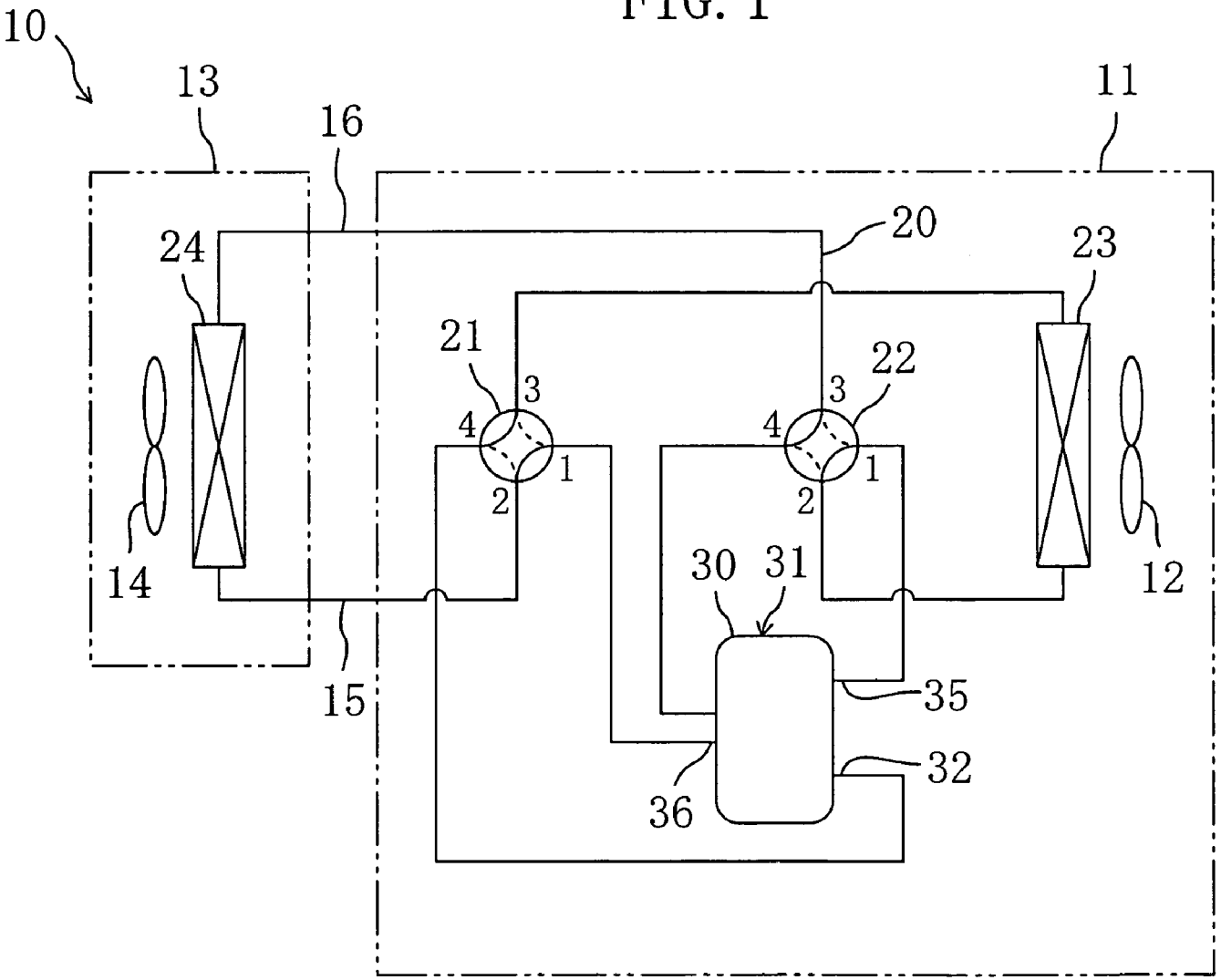
FIG. 1 is a piping system diagram of an air conditioner according to a first embodiment.

10 air conditioner
20 refrigerant circuit
30 compression/expansion unit
50 compression mechanism
60 expansion mechanism
70, 80 rotary mechanisms
71, 81 cylinders
72, 82 fluid chambers
73, 83 high pressure chambers
74, 84 low pressure chambers
75, 85 pistons (rotors)
90 volume change mechanism (volume changer)
91 auxiliary cylinder
92 auxiliary piston
93 auxiliary chamber
94 auxiliary tank
95 auxiliary passageway
96 auxiliary valve
100 scroll mechanism
103 auxiliary port
110 stationary scroll (scroll member)
111 stationary wrap
120 movable scroll (scroll member)
121 movable wrap
130 fluid chamber

BEST MODE FOR CARRYING OUT THE INVENTION

Embodiments of the present invention will be described hereinafter in detail with reference to the drawings.

Embodiment 1 of the Invention

-Overall Structure-

With reference to FIG. 1, an air conditioner (10) of this embodiment is a so-called "separate type" air conditioner, and includes an outdoor unit (11) and an indoor unit (13). The outdoor unit (11) houses therein an outdoor fan (12), an outdoor heat exchanger (23), a first four way switching valve (21), a second four way switching valve (22), and a compression/expansion unit (30). On the other hand, the indoor unit (13) houses therein an indoor fan (14) and an indoor heat exchanger (24). The outdoor unit (11) and the indoor unit (13) are connected together by a pair of interconnecting lines (15, 16).

A refrigerant circuit (20) with which the air conditioner (10) is equipped is a closed circuit along which the compression/expansion unit (30), the indoor heat exchanger (24), and other components are provided. Additionally, the refrigerant circuit (20) is filled up with carbon dioxide ($CO_2$) as a refrigerant and configured to effect a supercritical refrigeration cycle (a refrigeration cycle including a vapor pressure region having temperatures equal to and above the critical temperature).

In the outdoor heat exchanger (23), refrigerant in the refrigerant circuit (20) exchanges heat with outdoor air. In the indoor heat exchanger (24), refrigerant in the refrigerant circuit (20) exchanges heat with indoor air.

The first four way switching valve (21) has first, second, third, and fourth ports. In the first four way switching valve (21), the first port is connected to a discharge pipe (36) of the compression/expansion unit (30); the second port is connected to one end of the indoor heat exchanger (24) via the interconnecting line (15); the third port is connected to one end of the outdoor heat exchanger (23); and the fourth port is connected to a suction pipe (32) of the compression/expansion unit (30). The first four way switching valve (21) is switchable between a state that allows fluid communication between the first port and the second port and fluid communication between the third port and the fourth port (as indicated by the solid line in FIG. 1) and a state that allows fluid communication between the first port and the third port and fluid communication between the second port and the fourth port (as indicated by the broken line in FIG. 1).

The second four way switching valve (22) also has first, second, third, and fourth ports. In the second four way switching valve (22), the first port is connected to an outflow port (35) of the compression/expansion unit (30); the second port is connected to the other end of the outdoor heat exchanger (23); the third port is connected to the other end of the indoor heat exchanger (24) via the interconnecting line (16); and the fourth port is connected to an inflow port (34) of the compression/expansion unit (30). The second four way switching valve (22) is switchable between a state that allows fluid communication between the first port and the second port and fluid communication between the third port and the fourth port (as indicated by the solid line in FIG. 1) and a state that allows fluid communication between the first port and the third port and fluid communication between the second port and the fourth port (as indicated by the broken line in FIG. 1).

-Structure of the Compression/Expansion Unit-

Figure 2:
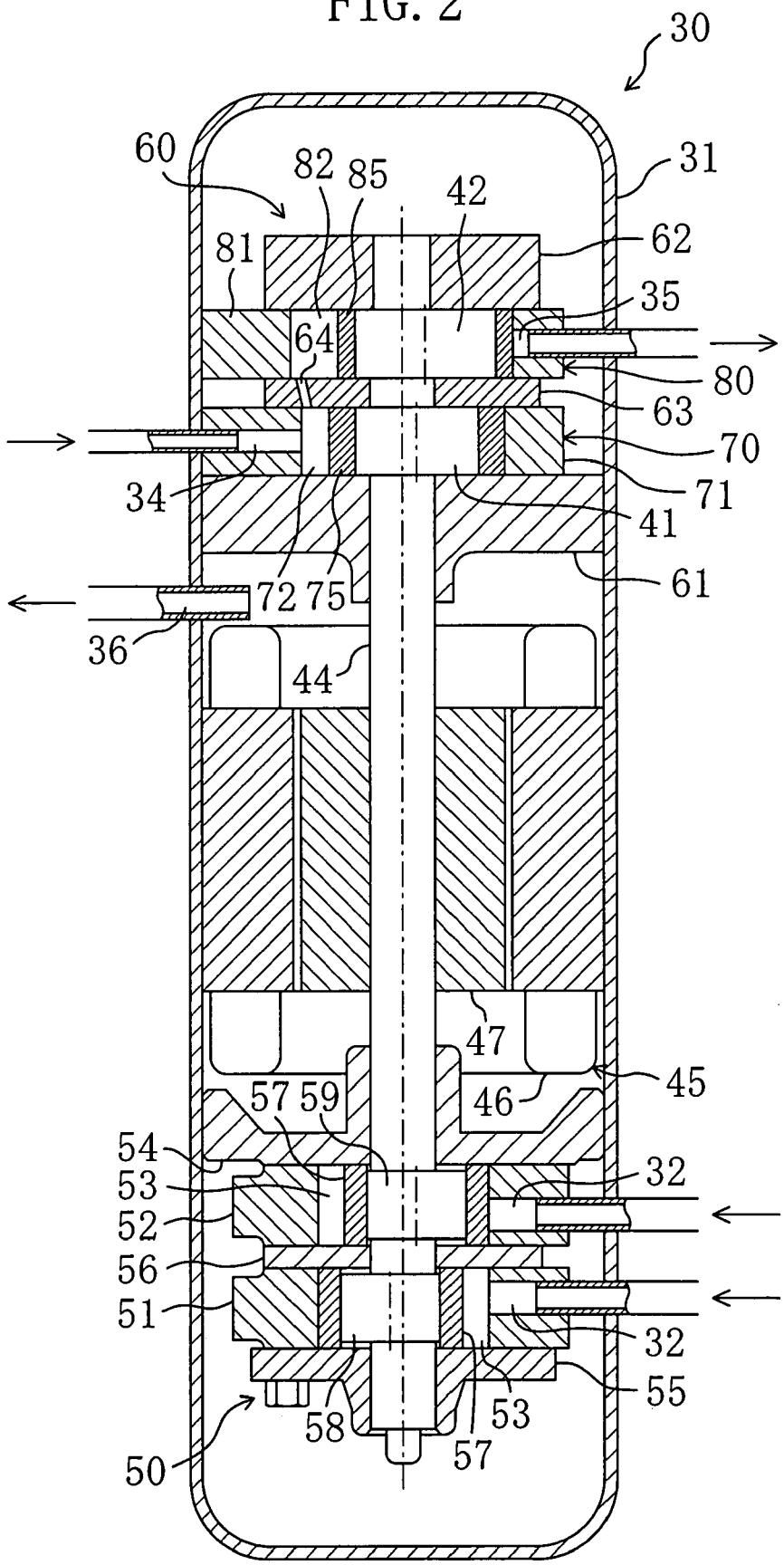
FIG. 2 is a schematic cross-sectional view of a compression/expansion unit of the first embodiment.

As shown in FIG. 2, the compression/expansion unit (30) includes a casing (31) which is a vertically long, cylinder-shaped, hermetically-closed container. Arranged, in bottom-to-top order, within the casing (31) are a compression mechanism (50), an electric motor (45), and an expansion mechanism (60).

A discharge pipe (36) is attached to the casing (31). The discharge pipe (36) is arranged between the electric motor (45) and the expansion mechanism (60) and is brought into fluid communication with the internal space of the casing (31).

The electric motor (45) is disposed in a longitudinally central portion of the casing (31). The electric motor (45) is composed of a stator (46) and a rotor (47). The stator (46) is firmly secured to the casing (31). The rotor (47) is passed through by a main shaft part (44) of a shaft (40). The shaft (40) forms a rotating shaft and is provided, at its lower end side, with two lower side eccentric parts (58, 59) while being provided, at its upper end side, with two upper side eccentric parts (41, 42).

The two lower side eccentric parts (58, 59) are formed so as to be greater in diameter than the main shaft part (44). A first lower side eccentric part (58) that is the upper one of the two lower side eccentric parts (58, 59) and a second lower side eccentric part (59) that is the lower one thereof are opposite to each other in eccentric direction relative to the center of axle of the main shaft part (44).

The two upper side eccentric parts (41, 42) are formed so as to be greater in diameter than the main shaft part (44). The first and second upper side eccentric parts (41, 42) are made eccentric in the same direction. The outer diameter of the second upper side eccentric part (42) is made greater than that of the first upper side eccentric part (41). In addition, the amount of eccentricity of the second upper side eccentric part (42) is made greater than that of the first upper side eccentric part (41).

The compression mechanism (50) forms a swinging piston type rotary compressor. The compressor mechanism (50) has two cylinders (51, 52) and two pistons (57). In the compression mechanism (50), a rear head (55), a first cylinder (51), an intermediate plate (56), a second cylinder (52), and a front head (54) are arranged in layered manner in bottom-to-top order.

The first and second cylinders (51, 52) each contain therein a cylindrical piston, i.e. the piston (57). Although not shown diagrammatically, a flat plate-like blade projects from the piston (57). The blade is supported, through a swinging bush, on each cylinder (51, 52). The first lower side eccentric part (58) of the shaft (40) is inserted into the piston (57) within the first cylinder (51). On the other hand, the second lower side eccentric part (59) of the shaft (40) is inserted into the piston (57) within the second cylinder (52). Each of compression chambers (53, 53) is formed between the outer peripheral surface of associated one of the pistons (57, 57) and the inner peripheral surface of associated one of the cylinders (51, 52).

The first and second cylinders (51, 52) each have a suction port (33). Each suction port (33) is extended to outside the casing (31) by a suction pipe (32).

Although not shown diagrammatically, a discharge port is formed in each of the front head (54) and the rear head (55). The discharge port of the front head (54) allows the compression chamber (53) within the second cylinder (52) to fluidly communicate with the internal space of the casing (31). The discharge port of the rear head (55) allows the compression chamber (53) within the first cylinder (51) to fluidly communicate with the internal space of the casing (31). In addition, although not shown diagrammatically, each discharge port is provided with a discharge valve. Gas refrigerant discharged into the internal space of the casing (31) from the compression mechanism (50) is fed out of the compression/expansion unit (30) by way of the discharge pipe (36).

The expansion mechanism (60) is a so-called swinging piston type fluid machine and provided with two pair combinations of cylinders (71, 81) and pistons (75, 85). In the expansion mechanism (60), a front head (61), a first cylinder (71), an intermediate plate (63), a second cylinder (81), and a rear head (62) are arranged in layered manner in bottom-to-top order. In this state, the lower end surface of the first cylinder (71) is blocked by the front head (61) and the upper end surface of the first cylinder (71) is blocked by the intermediate plate (63). On the other hand, the lower end surface of the second cylinder (81) is blocked by the intermediate plate (63) and the upper end surface of the second cylinder (81) is blocked by the rear head (62). In addition, the inside diameter of the second cylinder (81) is greater than the inside diameter of the first cylinder (71).

Figure 3:
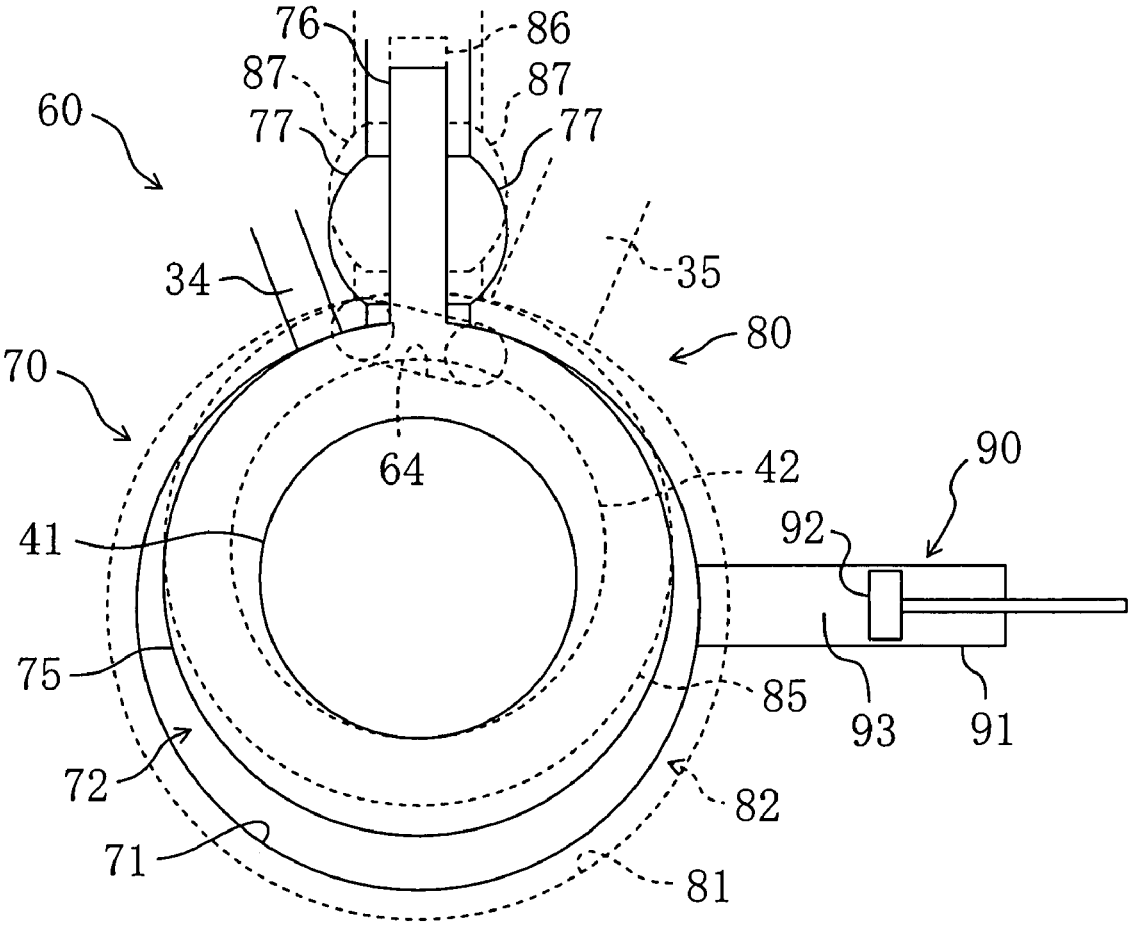
FIG. 3 is a diagram which illustrates in enlarged manner a main section of an expansion mechanism of the first embodiment.
Figure 4:
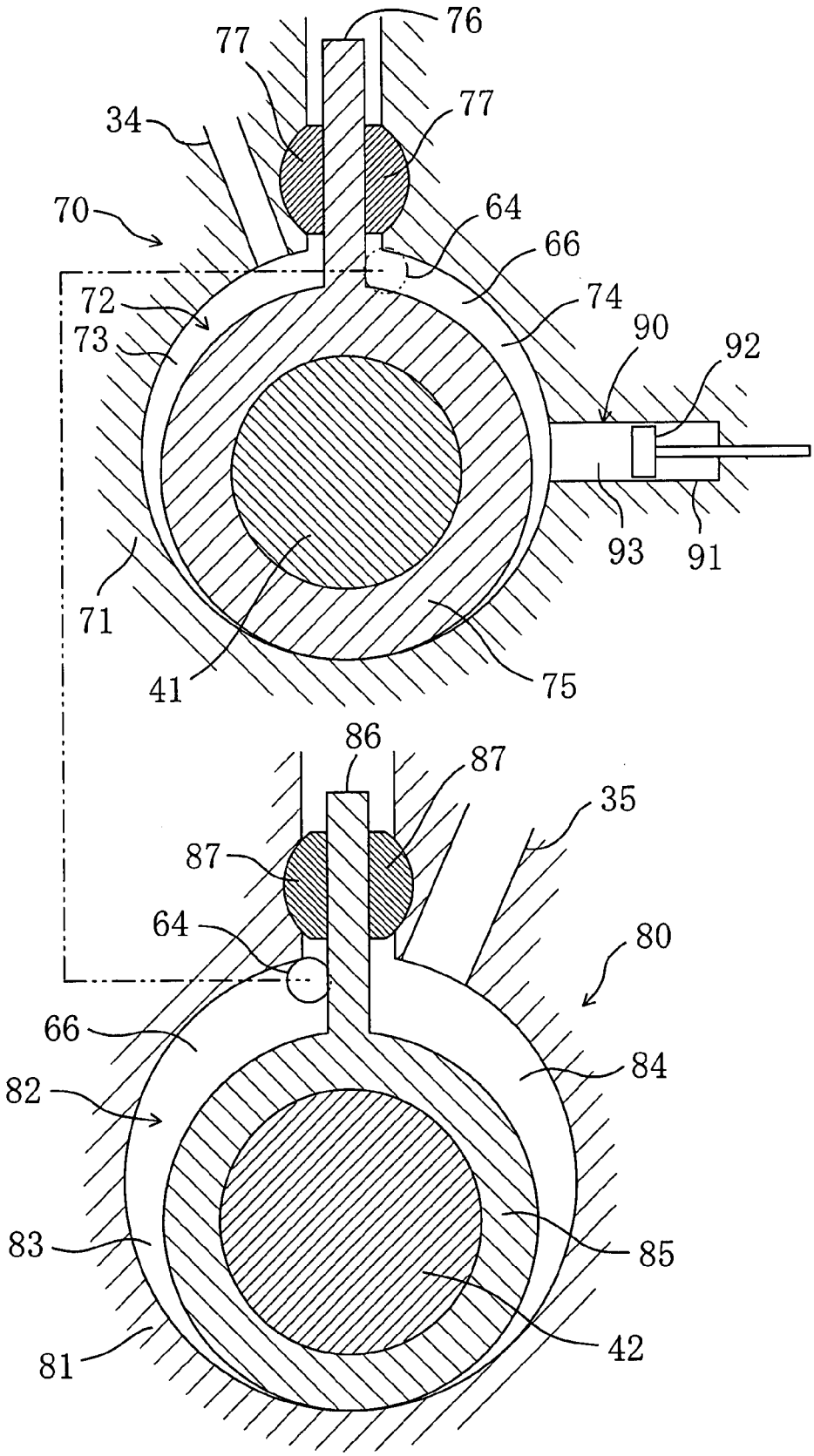
FIG. 4 is a diagram which individually illustrates in cross section rotary mechanisms of the expansion mechanism of the first embodiment.
Figure 5:
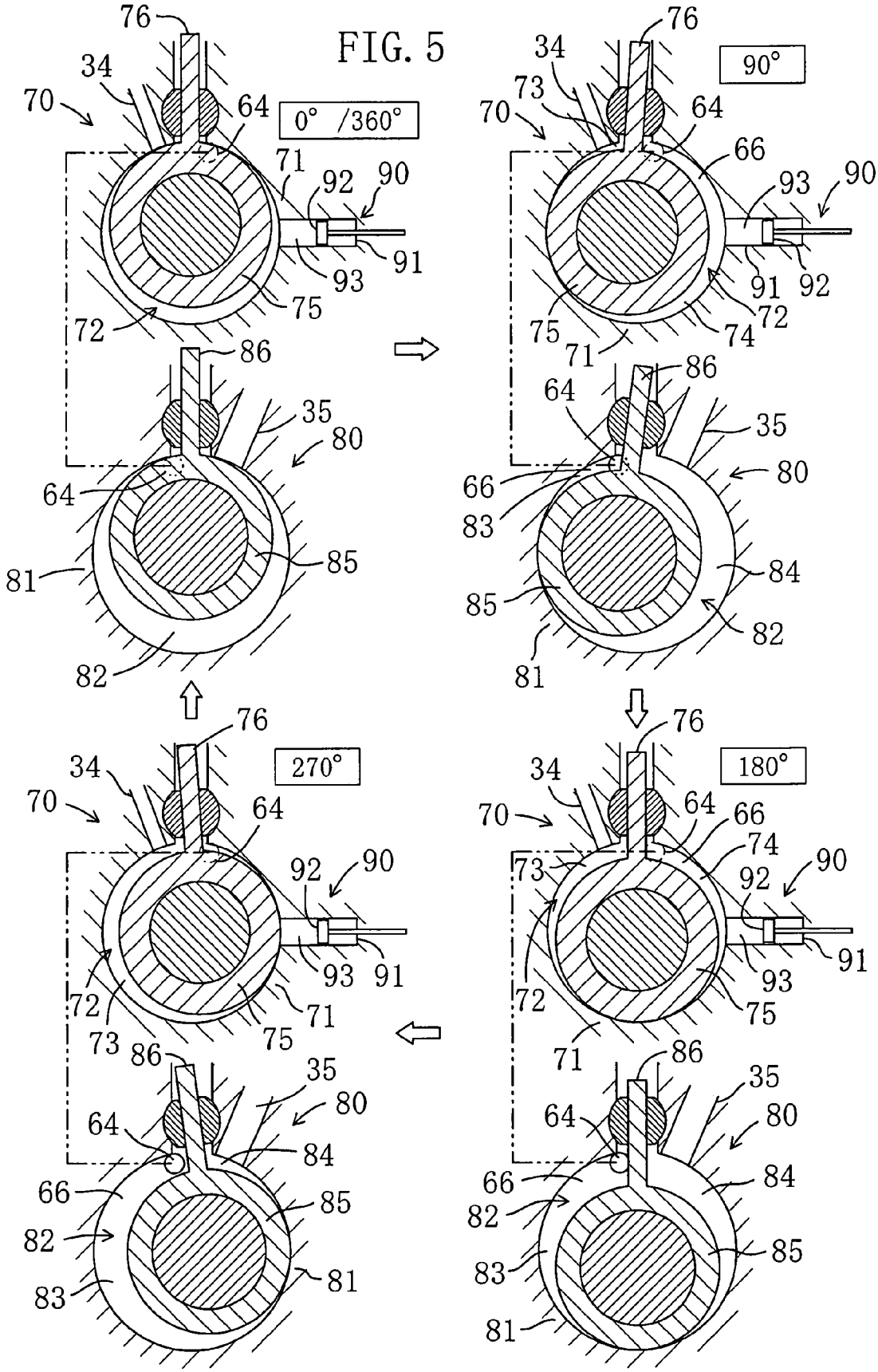
FIG. 5 is a diagram which illustrates in cross section the state of each rotary mechanism for each 90° rotation angle of the shaft of the expansion mechanism of the first embodiment.

The shaft (40) is passed through the expansion mechanism (60). As shown in FIGS. 3, 4 and 5, the first and second pistons (75, 85) are each shaped like a cylinder and form rotors. The first piston (75) and the second piston (85) are the same in outside diameter. The first upper side eccentric part (41) is passed through the first piston (75) and the second upper side eccentric part (42) is passed through the second piston (85).

Within the first cylinder (71), a first fluid chamber (72) is formed between the inner peripheral surface of the first cylinder (71) and the outer peripheral surface of the first piston (75). On the other hand, within the second cylinder (81), a second fluid chamber (82) is formed between the inner peripheral surface of the second cylinder (81) and the outer peripheral surface of the second piston (85).

The first piston (75) is provided with an integrally formed blade (76). The second piston (85) is also provided with an integrally formed blade (86). Each of the blades (76, 86) is shaped like a plate extending in the radial direction of the piston (75, 85), and projects outwardly from the outer peripheral surface of the piston (75, 85).

Each cylinder (71, 81) is provided with a pair of bushes (77, 87). One pair of bushes (77, 87) are disposed with the blade (76, 86) sandwiched therebetween. The blade (76, 86) is supported on the cylinder (71, 81) through the bushes (77, 87). The blade (76, 86) is allowed to freely rotate and to go up and down relative to the cylinder (71, 81).

The first fluid chamber (72) within the first cylinder (71) forms an expander chamber and is divided by the first blade (76), wherein one space defined on the left-hand side of the first blade (76) in FIG. 4 becomes a first high-pressure chamber (73) and the other space defined on the right-hand side of the first blade (76) in FIG. 4 becomes a first low-pressure chamber (74). The second fluid chamber (82) within the second cylinder (81) forms an expander chamber and is divided by the second blade (86), wherein one space defined on the left-hand side of the second blade (86) in FIG. 4 becomes a second high-pressure chamber (83) and the other space defined on the right-hand side of the second blade (86) in FIG. 4 becomes a second low-pressure chamber (84).

The first cylinder (71) and the second cylinder (81) are arranged in such orientation that the position of the bushes (77) of the first cylinder (71) and that of the bushes (87) of the second cylinder (81) agree with each other in circumferential direction. In other words, at the same time that the first blade (76) reaches its most withdrawn position relative to the direction of the outer periphery of the first cylinder (71), the second blade (86) reaches its most withdrawn position relative to the direction of the outer periphery of the second cylinder (81).

The first cylinder (71) is provided with an inflow port (34). The inflow port (34) opens into the inner peripheral surface of the first cylinder (71) to the left of the pair of bushes (77) in FIGS. 3 and 4. The inflow port (34) is allowed to be in fluid communication with the first high-pressure chamber (73) (i.e., the high pressure side of the first fluid chamber (72)). On the other hand, the second cylinder (81) is provided with an outflow port (35). The outflow port (35) opens into the inner peripheral surface of the second cylinder (81) to the right of the pair of bushes (87) in FIGS. 3 and 4. The outflow port (35) is allowed to be in fluid communication with the second low-pressure chamber (84) (i.e., the low-pressure side of the second fluid chamber (82)).

The intermediate plate (63) is provided with a communicating passageway (64). The communicating passageway (64) extends through the intermediate plate (63) in the thickness direction thereof. One end of the communicating passageway (64) opens to the right of the first blade (76). The other end of the communicating passageway (64) opens to the left of the second blade (86). As shown in FIG. 3, the communicating passageway (64) allows the first low-pressure chamber (74) and the second high-pressure chamber (83) to fluidly communicate with each other.

In the expansion mechanism (60) of this embodiment constructed in the way as described above, the first cylinder (71), the bushes (77), the first piston (75), and the first blade (76) together form a first rotary mechanism (70). In addition, the second cylinder (81), the bushes (87), the second piston (85), and the second blade (86) together form a second rotary mechanism (80).

In the expansion mechanism (60), the process in which the volume of the first low-pressure chamber (74) decreases in the first rotary mechanism (70), and the process in which the volume of the second high-pressure chamber (83) increases in the second rotary mechanism (80) are in synchronization (see FIG. 5). In addition, the first low-pressure chamber (74) of the first rotary mechanism (70) and the second high-pressure chamber (83) of the second rotary mechanism (80) are in fluid communication with each other via the communicating passage (64). The first low-pressure chamber (74), the communicating passage (64), and the second high-pressure chamber (83) together define a single closed space. The closed space forms an expansion chamber (66) serving as a single actuation chamber.

The above-mentioned configuration of the expansion mechanism (60) will be described hereinafter in detail. The rotation angle of the shaft (40) when the first blade (76) reaches its most withdrawn position relative to the direction of the outer periphery of the first cylinder (71) is 0°. In addition, assume that the maximum volume of the first fluid chamber (72) is 3 cc and the maximum volume of the second fluid chamber (82) is 10 cc.

At the point of time when the rotation angle of the shaft (40) is 0°, the volume of the first low-pressure chamber (74) assumes its maximum value of 3 cc and the volume of the second high-pressure chamber (83) assumes its minimum value of 0 cc. The volume of the first low-pressure chamber (74) diminishes as the shaft (40) rotates and, at the point of time when the rotation angle of the shaft (40) reaches a point of 360°, assumes its minimum value of 0 cc. On the other hand, the volume of the second high-pressure chamber (83) increases as the shaft (40) rotates and, at the point of time when the rotation angle of the shaft (40) reaches 360°, assumes its maximum value of 10 cc.

The volume of the expansion chamber (66) at a certain rotation angle is the sum of the volume of the first low-pressure chamber (74) and the volume of the second high-pressure chamber (83) at that certain rotation angle, when leaving the volume of the communicating passage (64) out of count. In other words, the volume of the expansion chamber (66) assumes a minimum value of 3 cc at the point of time when the rotation angle of the shaft (40) is 0°. As the shaft (40) rotates, the volume of the expansion chamber (66) gradually increases and assumes a maximum value of 10 cc at the point of time when the rotation angle of the shaft (40) reaches 360°.

On the other hand, the present invention is characterized in that the first rotary mechanism (70) is provided with a volume change mechanism (90) for changing the volume of the first fluid chamber (72) that is the expander chamber. The volume change mechanism (90) includes an auxiliary cylinder (91) and a direct-drive type auxiliary piston (92) contained in the auxiliary cylinder (91) and forms a volume changer. An auxiliary chamber (93) is formed inside the auxiliary cylinder (91) to be in fluid communication with the first fluid chamber (72). The auxiliary piston (92) is contained inside the auxiliary cylinder (91) to provide reciprocating, linear motion and configured to change the volume of the auxiliary chamber (93).

The first cylinder (71) of the first rotary mechanism (70) is formed with the auxiliary cylinder (91). As shown in FIG. 5, one end of the auxiliary cylinder (91) opens into a part of the inner peripheral surface of the first cylinder (71) associated with the first piston (75) when the rotation angle of the first piston (75) of the first rotary mechanism (70) is 270°. In other words, the auxiliary chamber (93) is in fluid communication with the first high-pressure chamber (73) (i.e., the high pressure side of the first fluid chamber (72)) serving as a suction chamber and configured such that the suction volume of the first fluid chamber (72) for refrigerant increases. Thereafter, with rotation of the first piston (75) and the second piston (85), the auxiliary chamber (93) is configured to be in fluid communication with the expansion chamber (66) composed of the first low-pressure chamber (74), the communicating passageway (64), and the second high-pressure chamber (83). The auxiliary cylinder (91) need only open into a part of the inner peripheral surface of the first cylinder (71) associated with the first piston (75) when the rotation angle of the first piston (75) is 180° through 360°.

When excessive expansion or insufficient expansion of refrigerant occurs, the auxiliary piston (92) moves to increase or decrease the volume of the auxiliary chamber (93). The auxiliary piston (92) substantially coincides with the inner peripheral surface of the first cylinder (71) when it is pushed forward and reaches the closest location to the opened end of the auxiliary cylinder (91). In this case, the volume of the auxiliary chamber (93) becomes substantially zero. On the other hand, the auxiliary piston (92) is located apart from the inner peripheral surface of the first cylinder (71) when it is moved backward and reaches the closest location to the other closed end of the auxiliary cylinder (91). In this case, the volume of the auxiliary chamber (93) becomes maximum. Although not shown diagrammatically, the location of the auxiliary piston (92) in the auxiliary cylinder (91) is controlled in accordance with operating conditions or other elements.

A case where excessive expansion of refrigerant occurs will be explained as follows. For example, under the operating conditions that cause decreasing of the pressure ratio of the vapor compression refrigeration cycle, the ratio of the density of refrigerant at the inlet of the compression mechanism (50) and the density of refrigerant at the inlet of an expansion mechanism (60) decreases. In this case, when the volume of the first high-pressure chamber (73) is constant, the mass flow rate of refrigerant passing through the expansion mechanism (60) becomes excessively small relative to the mass flow rate of refrigerant passing through the compression mechanism (50). Thus, excessive expansion occurs.

In the above-mentioned case, the auxiliary piston (92) is moved backward to increase the volume of the auxiliary chamber (93), resulting in an increase in the mass flow rate of refrigerant flowing into the first fluid chamber (72).

On the other hand, a case where insufficient expansion occurs will be explained as follows. For example, under the operating conditions that cause increasing of the pressure ratio of the vapor compression refrigeration cycle, the ratio of the density of refrigerant at the inlet of the compression mechanism (50) and the density of refrigerant at the inlet of an expansion mechanism (60) increases. In this case, when the volume of the first high-pressure chamber (73) is constant, the expansion ratio of refrigerant in the expansion mechanism (60) becomes small. Thus, insufficient expansion occurs.

In the above-mentioned case, the auxiliary piston (92) is pushed forward to decrease the volume of the auxiliary chamber (93), resulting in a decrease in the mass flow rate of refrigerant flowing into the first fluid chamber (72). This increases the expansion ratio of refrigerant in the expansion chamber (66).

-Operational Behavior-

The operation of the air conditioner (10) will be described.

(1) Cooling Operating Mode

In the cooling operating mode, the first four way switching valve (21) and the second four way switching valve (22) each change state to the state indicated by the broken line in FIG. 1. First, refrigerant compressed in the compression mechanism (50) is discharged through the discharge pipe (36). This discharged refrigerant is delivered by way of the first four way switching valve (21) to the outdoor heat exchanger (23). In the outdoor heat exchanger (23), the inflow refrigerant dissipates heat to outside air.

The refrigerant after heat dissipation passes through the second four way switching valve (22) and flows into the expansion mechanism (60) of the compression/expansion unit (30). In the expansion mechanism (60), the high-pressure refrigerant expands and its internal energy is converted into power which is used to rotate the shaft (40). The low-pressure refrigerant after expansion flows out through the outflow port (35), passes through the second four way switching valve (22), and is delivered to the indoor heat exchanger (24).

In the indoor heat exchanger (24), the refrigerant absorbs heat from room air and evaporates and, as a result, the room air is cooled. Low-pressure gas refrigerant exiting from the indoor heat exchanger (24) passes through the first four way switching valve (21) and is drawn into the compression mechanism (50) of the compression/expansion unit (30). The compression mechanism (50) compresses and then discharges the drawn refrigerant.

(2) Heating Operating Mode

In the heating operating mode, the first four way switching valve (21) and the second four way switching valve (22) each change state to the state indicated by the solid line in FIG. 1. First, refrigerant compressed in the compression mechanism (50) is discharged through the discharge pipe (36). This discharged refrigerant passes through the first four way switching valve (21) and is then delivered to the indoor heat exchanger (24). In the indoor heat exchanger (24), the inflow refrigerant dissipates heat to room air and, as a result, the room air is heated.

The refrigerant after heat dissipation in the indoor heat exchanger (24) passes through the second four way switching valve (22) and flows into the expansion mechanism (60) of the compression/expansion unit (30). In the expansion mechanism (60), the high-pressure refrigerant expands and its internal energy is converted into power which is used to rotate the shaft (40). The low-pressure refrigerant after expansion flows out by way of the outflow port (35), passes through the second four way switching valve (22), and is delivered to the outdoor heat exchanger (23).

In the outdoor heat exchanger (23), the refrigerant absorbs heat from outside air and evaporates. Thereafter, the low-pressure gas refrigerant passes through the first four way switching valve (21) and is drawn into the compression mechanism (50) of the compression/expansion unit (30). The compression mechanism (50) compresses and then discharges the drawn refrigerant.

(3) Operation of Expansion Mechanism (60)

The operation of the expansion mechanism (60) will be described below.

First, the process in which high-pressure refrigerant in the supercritical state flows into the first high-pressure chamber (73) of the first rotary mechanism (70) will be described with reference to FIG. 5. When the shaft (40) makes a slight rotation from the rotation angle 0° state, the position of contact between the first piston (75) and the first cylinder (71) passes through the inflow port (34), thereby allowing high-pressure refrigerant to start flowing into the first high-pressure chamber (73) from the inflow port (34). Thereafter, as the rotation angle of the shaft (40) gradually increases to 90°, then to 180°, and then to 270°, high-pressure refrigerant keeps flowing into the first high-pressure chamber (73). The flow of high-pressure refrigerant into the first high-pressure chamber (73) continues until the rotation angle of the shaft (40) reaches an angle of 360°.

Next, the process in which refrigerant expands in the expansion mechanism (60) will be described with reference to FIG. 5. When the shaft (40) makes a slight rotation from the rotation angle 0° state, the first low-pressure chamber (74)

and the second high-pressure chamber (83) become fluidly communicative with each other via the communicating passageway (64) and, as a result, refrigerant starts flowing into the second high-pressure chamber (83) from the first low-pressure chamber (74). Thereafter, as the rotation angle of the shaft (40) gradually increases to 90°, then to 180°, and then to 270°, the volume of the first low-pressure chamber (74) gradually decreases while simultaneously the volume of the second high-pressure chamber (83) gradually increases. Consequently, the volume of the expansion chamber (66) gradually increases. The volume of the expansion chamber (66) continues to increase just before the rotation angle of the shaft (40) reaches 360°. In the process during which the volume of the expansion chamber (66) increases, the refrigerant in the expansion chamber (66) expands. By virtue of such refrigerant expansion, the shaft (40) is rotationally driven. In this way, the refrigerant within the first low-pressure chamber (74) flows by way of the communication passage (64) into the second high-pressure chamber (83) while expanding.

In the refrigerant expansion process, the refrigerant pressure within the expansion chamber (66) falls as the rotation angle of the shaft (40) becomes increased. More specifically, refrigerant in the supercritical state with which the first low-pressure chamber (74) is filled up undergoes an abrupt pressure drop by the time the rotation angle of the shaft (40) reaches about 55°, and enters the saturated liquid state. Thereafter, the refrigerant within the expansion chamber (66) gradually decreases in pressure while partially evaporating.

Subsequently, the process in which refrigerant flows out of the second low-pressure chamber (84) of the second rotary mechanism (80) will be described. The second low-pressure chamber (84) starts fluidly communicating with the outflow port (35) from the point of time when the rotation angle of the shaft (40) is 0°. Stated another way, refrigerant starts flowing from the second low-pressure chamber (84) to the outflow port (35). Thereafter, the rotation angle of the shaft (40) gradually increases to 90°, then to 180°, and then to 270°. Over a period of time until the rotation angle of the shaft (40) reaches 360°, low-pressure refrigerant after expansion continuously flows out of the second low-pressure chamber (84).

(4) Operation of Volume Change Mechanism (90)

Next, the operation of the volume change mechanism (90) will be described. The description will be given based on the premise that the auxiliary piston (92) is controlled so as to be located at a predetermined location inside the auxiliary cylinder (91) and the auxiliary chamber (93) is set to have a predetermined volume.

First, for the first rotary mechanism (70), while the rotation angle of the shaft (40) shifts from 0° to 360°, high-pressure refrigerant flows into the first high-pressure chamber (73). Since in this suction process the auxiliary chamber (93) opens into the first high-pressure chamber (73), the amount of refrigerant flowing thereinto increases.

Subsequently, when the shaft (40) rotates from the state in which its rotation angle is 0°, the first low-pressure chamber (74) and the second high-pressure chamber (83) are in fluid communication with each other through the communicating passageway (64). With the rotation of the shaft (40), the volume of the expansion chamber (66) gradually increases. In this expansion process, refrigerant in the auxiliary chamber (93) also expands, resulting in an increase in the amount of expanded refrigerant.

Thereafter, the refrigerant flows out of the second low-pressure chamber (84) of the second rotary mechanism (80). In this case, the refrigerant in the auxiliary chamber (93) also flows through the second low-pressure chamber (84) into the outflow port (35).

Figure 6:
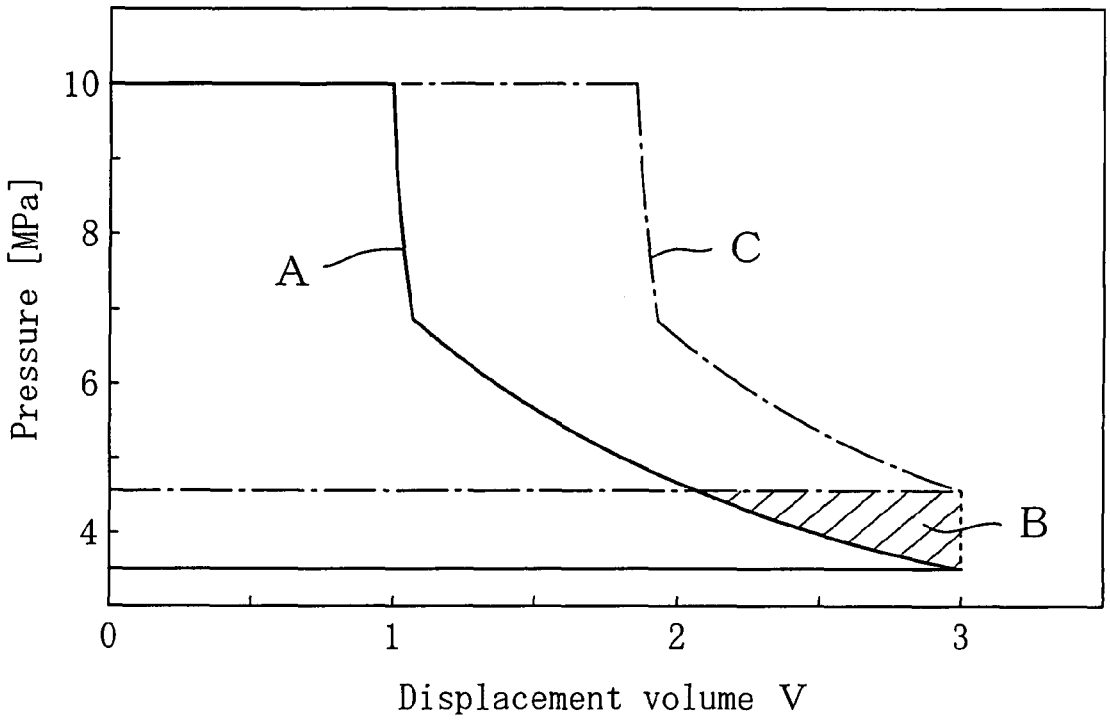
FIG. 6 is a graph illustrating the relationship between the displacement volume and refrigerant pressure of the expansion mechanism operated when excessive expansion has occurred in the expansion mechanism.

More specifically, when excessive expansion of refrigerant occurs, the ratio of the density of refrigerant at the inlet of the compression mechanism (50) and the density of refrigerant at the inlet of an expansion mechanism (60) decreases under the operating conditions that cause decreasing of the pressure ratio of the vapor compression refrigeration cycle. In this case, as shown by the solid line A in FIG. 6, when the volume of the first high-pressure chamber (73) is constant, the mass flow rate of refrigerant passing through the expansion mechanism (60) becomes excessively small relative to the mass flow rate of refrigerant passing through the compression mechanism (50). Thus, excessive expansion occurs as shown by the part B of FIG. 6. To cope with this, the auxiliary piston (92) is moved backward to increase the volume of the auxiliary chamber (93). This avoids excessive expansion as shown by the dot and dash line C in FIG. 6.

Figure 7:
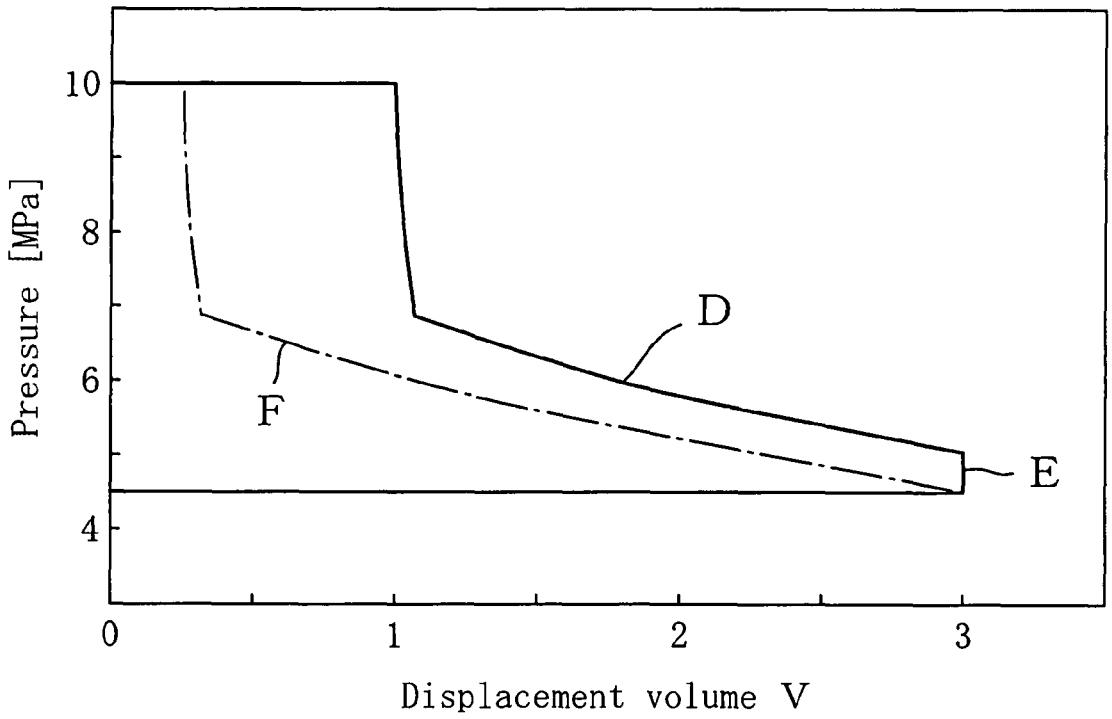
FIG. 7 is a graph illustrating the relationship between the displacement volume and refrigerant pressure of the expansion mechanism operated when insufficient expansion has occurred in the expansion mechanism.

On the other hand, when insufficient expansion occurs, the ratio of the density of refrigerant at the inlet of the compression mechanism (50) and the density of refrigerant at the inlet of an expansion mechanism (60) increases under the operating conditions that cause increasing of the pressure ratio of the vapor compression refrigeration cycle. In this case, as shown by the solid line D in FIG. 7, when the volume of the first high-pressure chamber (73) is constant, the expansion ratio of refrigerant in the expansion mechanism (60) becomes small. Thus, as shown by the part E of FIG. 7, insufficient expansion occurs. To cope with this, the auxiliary piston (92) is pushed forward to decrease the volume of the auxiliary chamber (93). This avoids insufficient expansion as shown by the dot and dash line F in FIG. 7.

Example 1

Figure 8A:
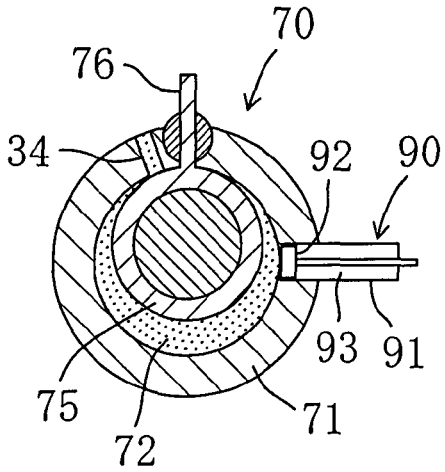
FIG. 8A is a cross-sectional view of a first rotary mechanism operated under a design point in Example 1.

FIGS. 8 and 9 illustrate a case where the present invention is applied to an air conditioner (10) for a warm region (in which the outside air temperature is not decreased so much during the winter months).

Figure 8B:
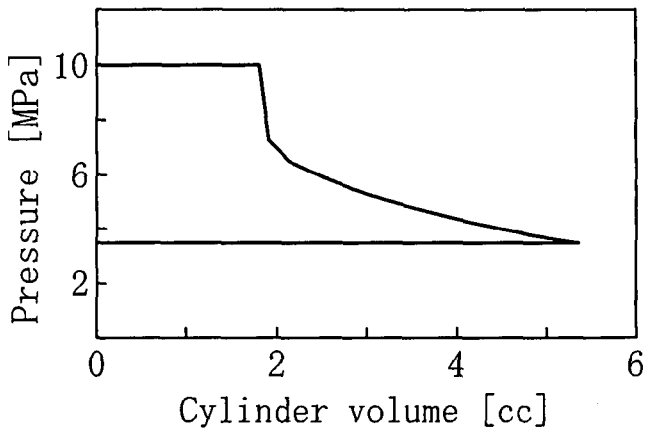
FIG. 8B is a graph illustrating the relationship between the refrigerant pressure and the cylinder volume.

In this air conditioner (10), as shown in FIG. 8, the operating conditions in the area in which the outside air temperature is around 0° C. during the winter months is used as a design point. During the winter months, the volume of only a first high-pressure chamber (73) is used as a volume for suction of refrigerant while the volume of an auxiliary chamber (93) is not used thereas. In this case, as shown in FIG. 8B, the expansion ratio of refrigerant under the actual operating conditions coincides with that under the design point. As a result, excessive and insufficient expansions never occur.

Figure 9A:
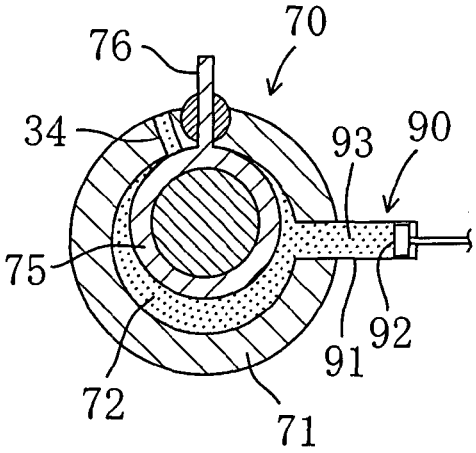
FIG. 9A is a cross-sectional view of a first rotary mechanism operated when excessive expansion is to be avoided in Example 1.
Figure 9B:
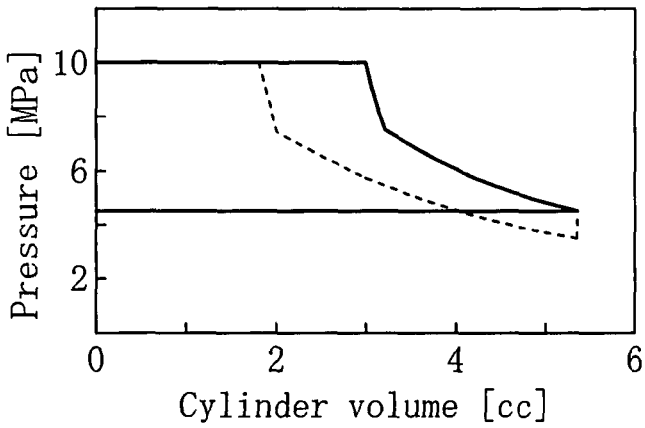
FIG. 9B is a graph illustrating the relationship between the refrigerant pressure and the cylinder volume.

On the other hand, during the summer months, as shown by the broken line in FIG. 9B, the mass flow rate of refrigerant passing through an expansion mechanism (60) becomes excessively small relative to the mass flow rate of refrigerant passing through a compression mechanism (50). For this reason, when the volume of the auxiliary chamber (93) is zero, excessive expansion occurs. To cope with this, as shown in FIG. 9A, the air conditioner (10) operates while the volume of the auxiliary chamber (93) is increased and the amount of drawn refrigerant is increased. This avoids excessive expansion as shown by the solid line in FIG. 9B.

When the fixed amount of drawn refrigerant during the winter months is set at 1, the volume of the auxiliary chamber (93) during the summer months need be substantially twice as large as the fixed amount of drawn refrigerant during the winter months. For this reason, the volume of the auxiliary chamber (93) is equal to that of the first high-pressure chamber (73). For example, when the volume of the first high-pressure chamber (73) is 2 cc, the volume of the auxiliary chamber (93) is also 2 cc.

Example 2

Figure 10A:
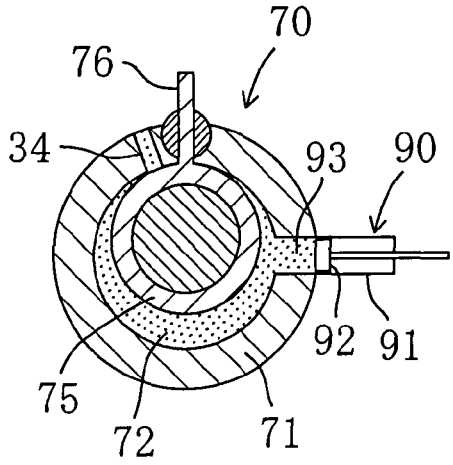
FIG. 10A is a cross-sectional view of a first rotary mechanism operated under a design point in Example 2.

FIGS. 10 through 12 illustrate a case where the present invention is applied to an air conditioner (10) for a cold region (in which the air conditioner (10) may be used when the outside air temperature is −10° C.).

Figure 10B:
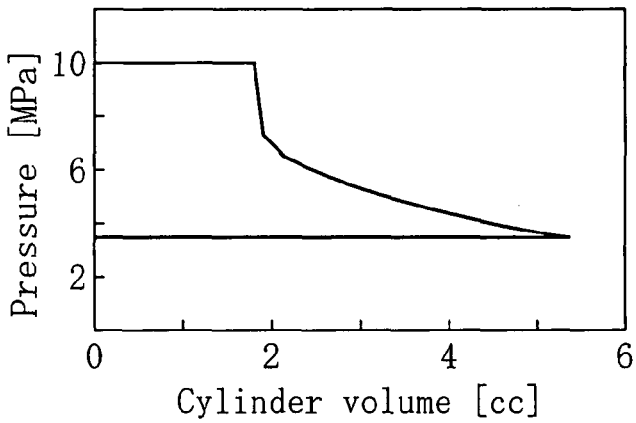
FIG. 10B is a graph illustrating the relationship between the refrigerant pressure and the cylinder volume.

In this air conditioner (10), as shown in FIG. 10, the state in which 30% of the volume of the auxiliary chamber (93) is used under the operating conditions in the area in which the outside air temperature is around 0° C. during the winter months is used as a design point. During the winter months at such an outside air temperature, the sum of the volume of a first high-pressure chamber (73) and 30% of the volume of the auxiliary chamber (93) is used as a volume for suction of refrigerant suction volume. In this case, as shown in FIG. 10B, the expansion ratio of refrigerant under the actual operating conditions coincides with that under the design point. As a result, excessive and insufficient expansions never occur.

Figure 11A:
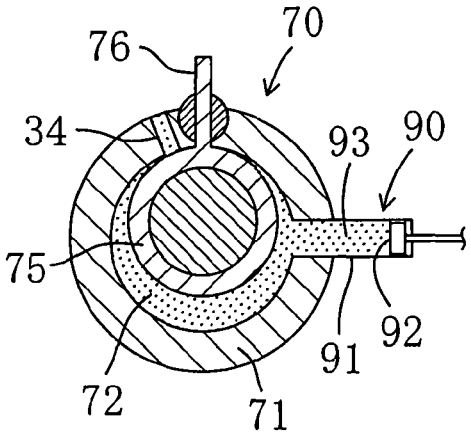
FIG. 11A is a cross-sectional view of a first rotary mechanism operated when excessive expansion is to be avoided in Example 2.
Figure 11B:
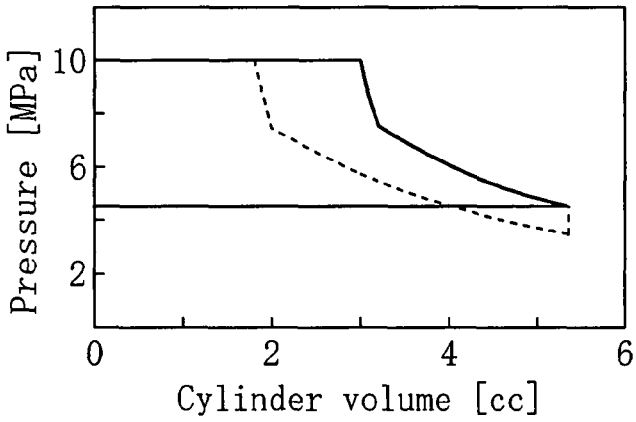
FIG. 11B is a graph illustrating the relationship between the refrigerant pressure and the cylinder volume.

On the other hand, during the summer months, as shown by the broken line in FIG. 11B, the mass flow rate of refrigerant passing through an expansion mechanism (60) becomes excessively small relative to the mass flow rate of refrigerant passing through a compression mechanism (50). For this reason, when 30% of the volume of the auxiliary chamber (93) is used, excessive expansion occurs. To cope with this, as shown in FIG. 11A, the air conditioner (10) operates while the maximum volume of the auxiliary chamber (93) is used and the amount of drawn refrigerant is increased. This avoids excessive expansion as shown by the solid line in FIG. 11B.

Figure 12A:
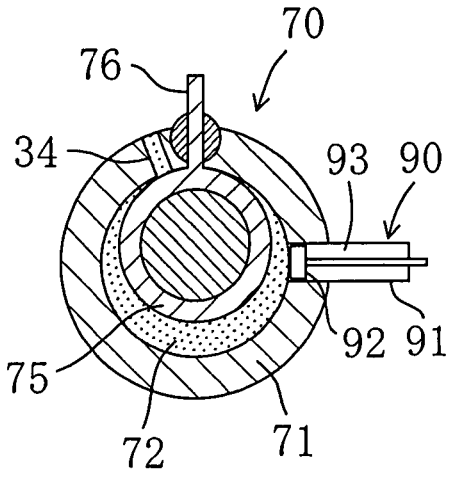
FIG. 12A is a cross-sectional view of a first rotary mechanism operated when insufficient expansion is to be avoided in Example 1.
Figure 12B:
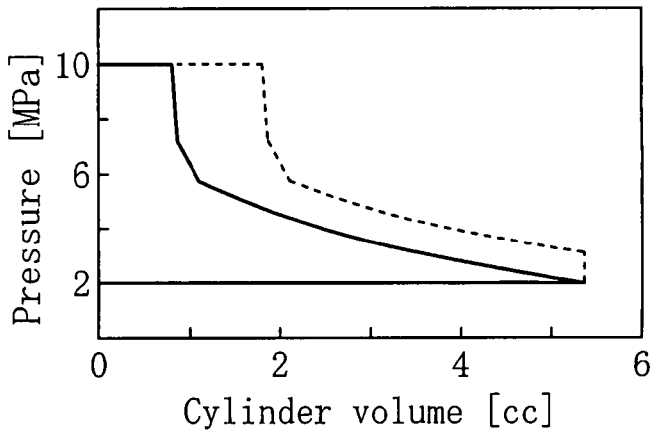
FIG. 12B is a graph illustrating the relationship between the refrigerant pressure and the cylinder volume.

During the severe winter period, as shown by the broken line in FIG. 12B, the mass flow rate of refrigerant passing through an expansion mechanism (60) becomes excessively large relative to the mass flow rate of refrigerant passing through a compression mechanism (50). For this reason, when 30% of the volume of the auxiliary chamber (93) is used, insufficient expansion occurs. To cope with this, as shown in FIG. 12A, the air conditioner (10) operates while the volume of the auxiliary chamber (93) is zero and the amount of drawn refrigerant is decreased. This avoids insufficient expansion as shown by the solid line in FIG. 12B.

The volume of the auxiliary chamber (93) is as follows. Since the volume of the auxiliary chamber (93) at the design point is small, the volume of the auxiliary chamber (93) which becomes necessary during the summer months is approximately 1.6 times as large as that of the first high-pressure chamber (73).

Effects of Embodiment 1

As described above, according to this embodiment, a volume change mechanism (90) is provided to increase or decrease the volume of a first fluid chamber (72) of a first rotary mechanism (70). Therefore, an increase or a decrease in the volume of an auxiliary chamber (93) can avoid excessive expansion of refrigerant and certainly avoid insufficient expansion of refrigerant. As a result, the operation efficiency of an expander can be enhanced.

In the volume change mechanism (90), the volume of the auxiliary chamber (93) is adjusted by an auxiliary piston (92). This can exactly increase or decrease the volume of the first fluid chamber (72). Furthermore, with a simple structure, the volume of the first fluid chamber (72) can be increased or decreased.

Furthermore, an expansion mechanism (60) includes two rotary mechanisms (70, 80). This allows a first high-pressure chamber (73) and an expansion chamber (66) to be certainly defined, thereby expanding refrigerant with reliability.

Since the expansion mechanism (60) is connected to a compression mechanism (50), the pressure energy of refrigerant can be recovered as power with reliability, resulting in an enhancement in operation efficiency.

Since $CO_2$ is used as refrigerant, an environment-compatible refrigerant circuit (20) can be configured.

Embodiment 2 of the Invention

Next, a second embodiment of the present invention will be described in detail with reference to the drawings.

In the first embodiment, two rotary mechanisms (70, 80) form an expansion mechanism (60). On the other hand, in this embodiment, a scroll mechanism (100) forms an expansion mechanism (60) as shown in FIGS. 13 through 18.

More specifically, the scroll mechanism (100) includes a stationary scroll (110) secured to a frame (not shown) of a casing (31) and a movable scroll (120) supported by the frame through an Oldham ring.

The stationary scroll (110) forms a scroll member and includes a flat plate-like stationary end plate (not shown) and a spiral stationary wrap (111) vertically placed on the stationary end plate. On the other hand, the movable scroll (120) forms a scroll member and includes a flat plate-like movable end plate (not shown) and a spiral movable wrap (121) vertically placed on the movable end plate. The stationary wrap (111) of the stationary scroll (110) engages with the movable wrap (121) of the movable scroll (120) so that a plurality of fluid chambers (130) are formed.

The stationary scroll (110) is provided with an inflow port (101), an outflow port (102), and two auxiliary ports (103). The inflow port (101) opens in the vicinity of the end of the stationary wrap (111) from which the spiral starts. This inflow port (101) is in fluid communication with an indoor heat exchanger (24) or an outdoor heat exchanger (23). The outflow port (102) opens in the vicinity of the end of the stationary wrap (111) at which the spiral ends. This outflow port (102) is in fluid communication with the indoor heat exchanger (24) or the outdoor heat exchanger (23).

The plurality of fluid chambers (130) form expander chambers. A space between the inner peripheral surface of the stationary wrap (111) and the outer peripheral surface of the movable wrap (121) forms an A chamber (132) serving as one of the fluid chambers (130), that is, a first fluid chamber (130). A space between the outer peripheral surface of the stationary wrap (111) and the inner peripheral surface of the movable wrap (121) forms a B chamber (131) serving as another of the fluid chambers (130), that is, a second fluid chamber (130).

When the movable scroll (120) makes a 180° orbital motion relative to the stationary scroll (110), the two auxiliary ports (103) starts fluidly communicating with the fluid chambers (130). After completion of the suction process (0°), the two auxiliary ports (103) are brought in fluid communication with the A chamber (132) and the B chamber (131) until the midstream of the expansion process, more specifically, until the movable scroll (120) makes a 180° orbital motion.

The two auxiliary ports (103) are in fluid communication with the auxiliary chamber (93) of the volume change mechanism (90) of the embodiment. In other words, the volume change mechanism (90) is configured such that the volumes of the A chamber (132) and the B chamber (131) serving as the expander chambers are changed using the two auxiliary ports (103). The other structure is the same as in the first embodiment.

-Operational Behavior-

Next, the expansion of the scroll mechanism (100) will be described.

First, high-pressure refrigerant is introduced from the inflow port (101) and then flows into one of the fluid chambers (130) interposed between the vicinity of where the stationary wrap (111) starts and the vicinity of where the movable wrap (120) starts. In summary, the high-pressure refrigerant is introduced from the inflow port (101) into the fluid chamber (130) during the suction process.

Figure 13:
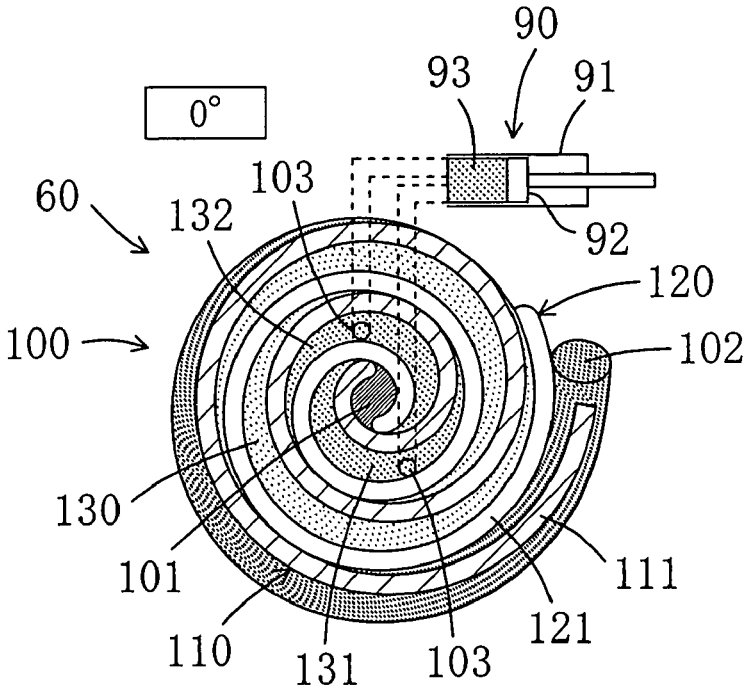
FIG. 13 is a cross-sectional view of a scroll mechanism according to a second embodiment when the revolution angle thereof is 0°.
Figure 14:
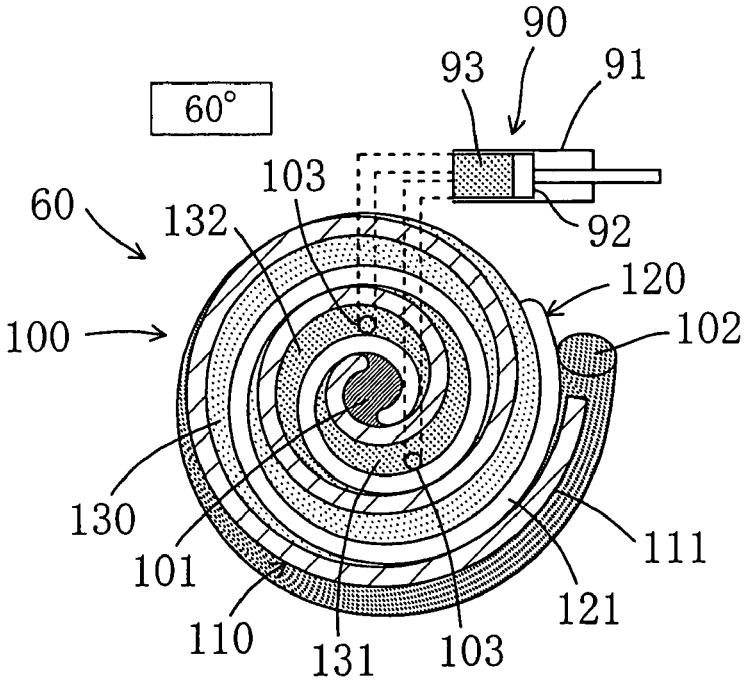
FIG. 14 is a cross-sectional view of the scroll mechanism according to the second embodiment when the revolution angle thereof is 60°.
Figure 15:
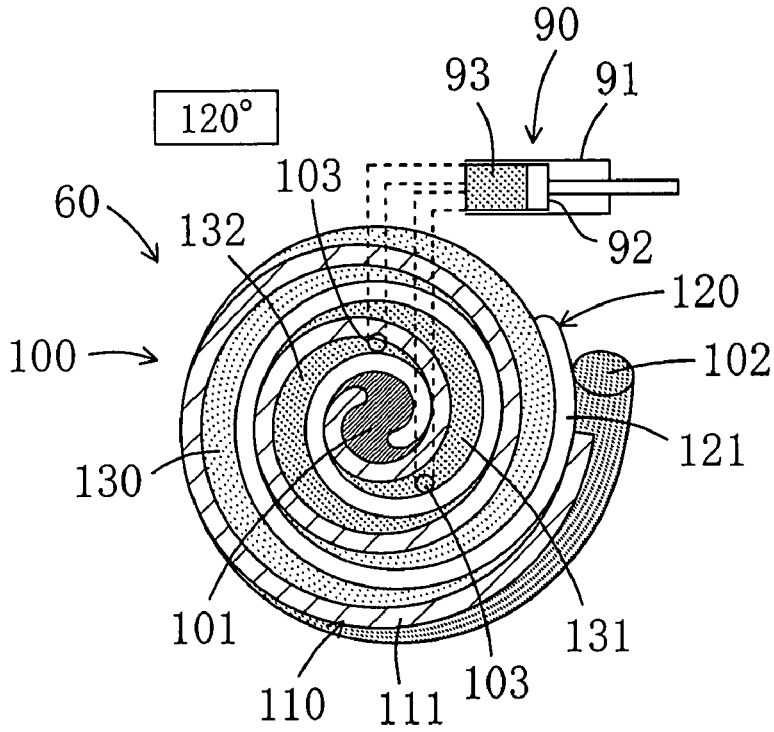
FIG. 15 is a cross-sectional view of the scroll mechanism according to the second embodiment when the revolution angle thereof is 120°.
Figure 16:
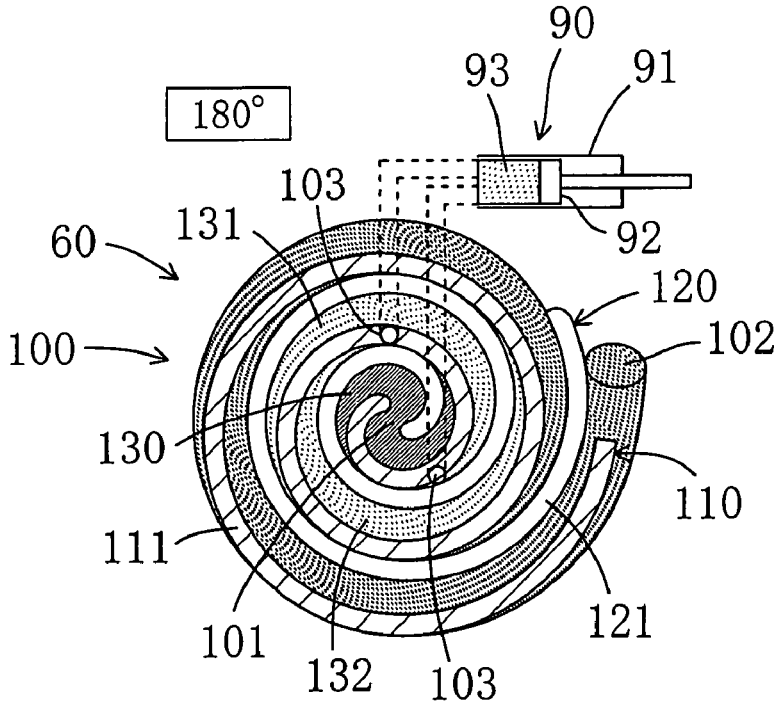
FIG. 16 is a cross-sectional view of the scroll mechanism according to the second embodiment when the revolution angle thereof is 180°.

In FIG. 13, the end of the stationary wrap (111) from which the spiral starts is in contact with the inner peripheral surface of the movable wrap (121), and simultaneously the end of the movable wrap (121) from which the spiral starts is in contact with the inner peripheral surface of the stationary wrap (111). This state is set at 0° as the reference.

In this state set at 0°, the A chamber (132) and the B chamber (131) are completely closed, and the suction process is completed. High-pressure refrigerant flows through the auxiliary ports (103) also into the auxiliary chamber (93).

Subsequently, the movable scroll (120), makes an orbital motion. The expansion process is carried out until the revolution angle of the movable scroll (120) changes through 60° (see FIG. 14) and then 120° (see FIG. 15) to 180° (see FIG. 16). In this expansion process, the refrigerant expands in the A chamber (132) and the B chamber (131). In this case, the refrigerant in the auxiliary chamber (93) also expands.

Figure 17:
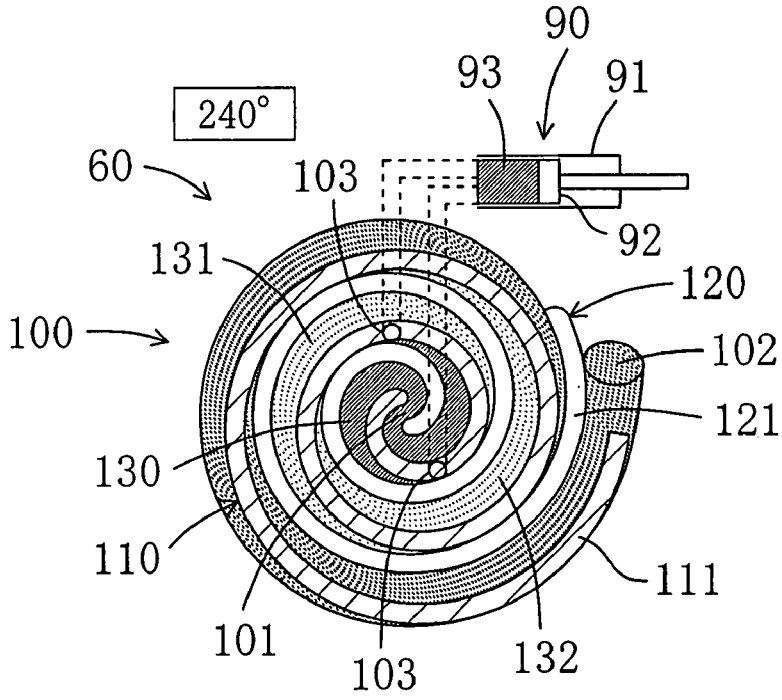
FIG. 17 is a cross-sectional view of the scroll mechanism according to the second embodiment when the revolution angle thereof is 240°.
Figure 18:
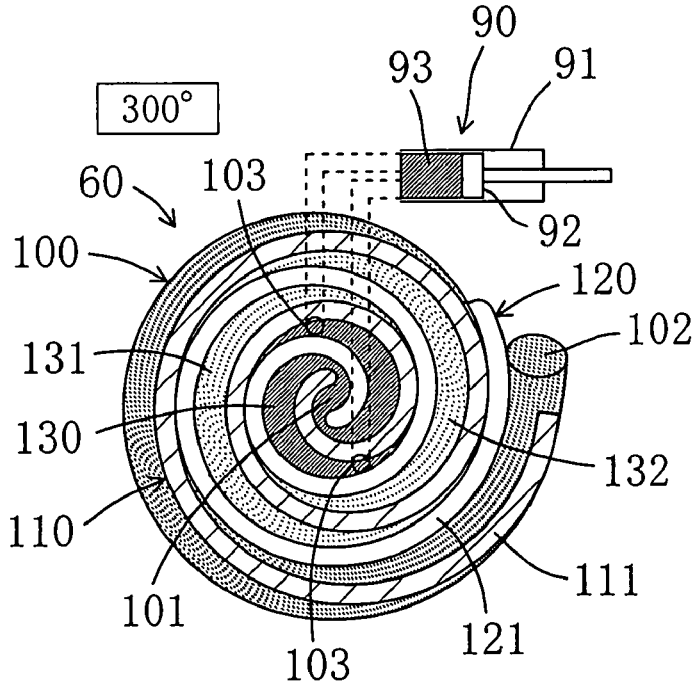
FIG. 18 is a cross-sectional view of the scroll mechanism according to the second embodiment when the revolution angle thereof is 300°.

Thereafter, when the revolution angle of the movable scroll (120) exceeds 180°, the auxiliary ports (103) are in fluid communication with the fluid chambers (130) during the suction process as shown in FIG. 17. Meanwhile, the refrigerant expands in the A chamber (132) and the B chamber (131).

The movable scroll (120) further makes an orbital motion. The refrigerant expands in the A chamber (132) and the B chamber (131) until the revolution angle of the movable scroll (120) changes through 240° (see FIG. 17) and then 300° (see FIG. 18) to 0° (see FIG. 13). Meanwhile, refrigerant is introduced into the auxiliary chamber (93). When the revolution angle is 0°, the A chamber (132) and the B chamber (131) are in fluid communication with the outflow port (102). In this state, an outflow process is started.

Use of the auxiliary chamber (93) allows the volumes of the A chamber (132) and the B chamber (131) to be increased or decreased, i.e., controlled, like the first embodiment. This avoids excessive expansion and insufficient expansion of refrigerant. The other behaviors are the same as in the first embodiment.

Effects of Embodiment 2

In view of the above, according to this embodiment, use of the scroll mechanism (100) allows the volumes of the fluid chambers (130) serving as expander chambers to change. This can certainly avoid excessive expansion and insufficient expansion of refrigerant. The other effects are the same as in the first embodiment.

Embodiment 3 of the Invention

Next, a third embodiment of the present invention will be described in detail with reference to the drawings.

Figure 19:
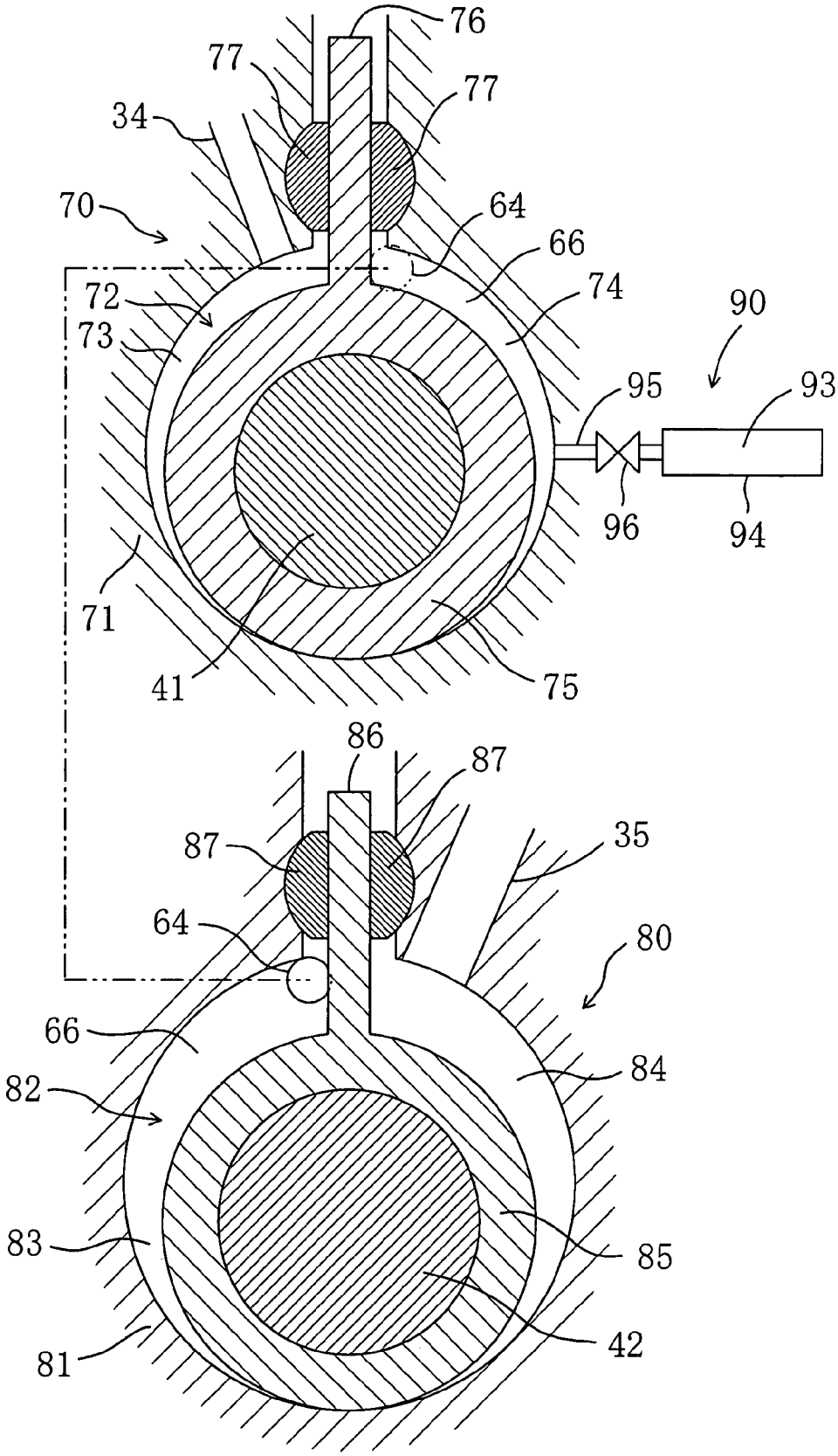
FIG. 19 is a diagram which individually illustrates in cross section rotary mechanisms of the expansion mechanism of the third embodiment.

Although in the first embodiment the auxiliary piston (92) is used for the volume change mechanism (90), an auxiliary valve (96) is used instead in this embodiment as shown in FIG. 19.

More specifically, the volume change mechanism (90) of this embodiment is configured such that an auxiliary tank (94) is in fluid communication with a first high-pressure chamber (73) of a first rotary mechanism (70) through an auxiliary passageway (95). The auxiliary passageway (95) is provided with the auxiliary valve (96). An auxiliary chamber (93) is formed inside the auxiliary tank (94) to increase or decrease the volume of a first fluid chamber (72). Meanwhile, the auxiliary valve (96) is composed of an opening/closing valve serving as an opening/closing unit and controls the state of the auxiliary chamber (93) by switching between the state in which the auxiliary chamber (93) is in fluid communication with the first fluid chamber (72) and the state in which the auxiliary chamber (93) is closed.

In view of the above, in this embodiment, the volume of the first fluid chamber (72) is changed between two states. In one of the two states, the auxiliary valve (96) opens so that the volume of the first fluid chamber (72) is increased by the volume of the auxiliary chamber (93). In the other one of the two states, the auxiliary valve (96) is closed so that the volume of the auxiliary chamber (93) is not included in the volume of the first fluid chamber (72).

A flow rate adjusting valve serving as a flow rate adjuster may be used as the auxiliary valve (96) instead of the opening/closing valve. In this case, the amount of refrigerant flowing into the auxiliary chamber (93) varies according to the opening of the auxiliary valve (96). As a result, the volume of the auxiliary chamber (93) is changed substantially successively or in a plurality of steps. Thus, the volume of the first fluid chamber (72) is increased or decreased according to the flow rate of refrigerant. The other structures, behaviors and effects are the same as in the first embodiment.

Other Embodiments

In the above embodiments, a pair of rotary mechanisms (70, 80) or a scroll mechanism (100) is used as an expansion mechanism (60). However, the present invention is not limited to such an expansion mechanism (60). In other words, any unit for increasing or decreasing the volume of an expander chamber need only be used as an expansion mechanism (60) of the present invention.

INDUSTRIAL APPLICABILITY

As described above, the present invention is useful as an expander for expanding refrigerant.

The invention claimed is:

1. A positive displacement expander used for a refrigerant circuit of a supercritical refrigeration cycle, the expander comprising:

a volume changer for changing the volume of an expander chamber, the volume changer including an auxiliary chamber fluidly communicating with the expander chamber and a piston for changing the volume of the auxiliary chamber.

2. A positive displacement expander used for a refrigerant circuit of a supercritical refrigeration cycle, the expander comprising:

a volume changer for changing the volume of an expander chamber, the volume changer including an auxiliary chamber fluidly communicating with the expander chamber, and an opening/closing mechanism placed between the auxiliary chamber and the expander chamber.

3. A positive displacement expander used for a refrigerant circuit of a supercritical refrigeration cycle, the expander comprising:

a volume changer for changing the volume of an expander chamber, the volume changer including an auxiliary chamber fluidly communicating with the expander chamber and a flow rate adjusting mechanism placed between the auxiliary chamber and the expander chamber.

4. A positive displacement expander used for a refrigerant circuit of a supercritical refrigeration cycle, the expander comprising:

a volume changer for changing the volume of an expander chamber, wherein an expansion mechanism including the expander chamber comprises a first rotary mechanism and a second rotary mechanism each having a cylinder containing a rotor, the expander chamber of the first rotary mechanism and an expander chamber of the second rotary mechanism are in fluid communication with each other to form an actuation chamber, the expander chamber of the first rotary mechanism being smaller than the expander chamber of the second rotary mechanism, and the volume changer is in fluid communication with the expander chamber of the first rotary mechanism.

5. A positive displacement expander used for a refrigerant circuit of a supercritical refrigeration cycle, the expander comprising:

a volume changer for changing the volume of an expander chamber, wherein an expansion mechanism including the expander chamber comprises a pair of scroll members each having an end plate and a spiral wrap formed on the end plate, the respective wraps of the scroll members engaging with each other, and is composed of a scroll mechanism including at least one pair of expander chambers, and the volume changer is in fluid communication with the expander chamber.

6. The expander of claim 1, wherein an expansion mechanism forming the expander chamber is connected to a compression mechanism placed somewhere along the refrigerant circuit.

7. The expander of claim 1, wherein refrigerant used for the refrigerant circuit is $CO_2$.

* * * * *